US005669669A

United States Patent [19]

Usher

[11] Patent Number: 5,669,669

[45] Date of Patent: Sep. 23, 1997

[54] CHILD'S BALANCE SEAT

[76] Inventor: Gregory Jerome Usher, P.O. Box 2, Berry N.S.W. 2535, Australia

[21] Appl. No.: 591,321

[22] Filed: Jan. 25, 1996

[51] Int. Cl.[6] ..... A47C 7/52

[52] U.S. Cl. ..... 297/423.12; 297/423.11; 297/313

[58] Field of Search ..... 297/423.11, 423.12, 297/313, 337, 344.1

[56] References Cited

U.S. PATENT DOCUMENTS

| | | | |
|---|---|---|---|
| 3,669,493 | 6/1972 | Vowles | 297/423.11 |
| 4,564,237 | 1/1986 | Steifensand | 297/423.11 |
| 4,589,699 | 5/1986 | Dungan | 297/423.12 |
| 4,614,378 | 9/1986 | Picou | 297/423.11 X |
| 4,650,249 | 3/1987 | Serber | 297/423.11 X |
| 4,765,684 | 8/1988 | Kvalheim et al. | 297/313 X |
| 4,843,999 | 7/1989 | Kobus et al. | 297/313 X |
| 5,123,697 | 6/1992 | Szczurek | 297/427.12 X |
| 5,251,961 | 10/1993 | Pass | 297/423.12 |
| 5,255,957 | 10/1993 | Opsvik et al. | 297/423.12 |
| 5,330,254 | 7/1994 | Larson | 297/423.12 X |

FOREIGN PATENT DOCUMENTS

| | | | |
|---|---|---|---|
| 3541120 | 5/1987 | Germany | 297/423.12 |
| 1734679 | 5/1992 | U.S.S.R. | 297/423.12 |
| 2176396 | 12/1986 | United Kingdom | 297/423.12 |
| 8800016 | 1/1988 | WIPO | 297/423.12 |

*Primary Examiner*—Peter M. Cuomo
*Assistant Examiner*—Rodney B. White

[57] ABSTRACT

A children's balance seat with attachment mechanisms for the seat and shin cushion enabling these to be moved and adjusted as the child grows. The particular shape and construction of the above mechanisms also facilitates free forward and backward movement and this movement can be further assisted by means of an adjustable spring.

2 Claims, 2 Drawing Sheets

CHILD'S BALANCE SEAT

This invention relates to a balance seat but more specifically:

(A) The shin cushion and seat base attachment mechanisms of a balance seat frame which enable the seat to be used by children through their growing years; and (B) A spring device to assist movement.

Kneel/sit stools are fairly well-known devices designed to take pressure off the spine and transfer it to the knees as well and opening up the angle between the thighs and the trunk so as to improve posture. Major drawbacks of these stools have been their rigid design, the fixed angle between seat and kneeler and lack of a model designed specifically for young and growing children.

To achieve the object above, the present invention provides a children-use balance seat which comprises a seat, a shin cushion and a sled-shaped frame. At one end of the frame are provided opposedly a support member with a plurality of half-round grooves thereon on one side and a support member with a plurality of round holes therein on the other side for supporting the seat; at the other end of the frame are provided opposedly two similar support members each on one side, respectively, for supporting the shin cushion.

The said support members on both sides for supporting the seat are combined ones, including support portions, integral with the frame, which is made up of tubular squared section and support bars, which have each a squared section corresponding to the squared section of the frame and are telescoped into the frame beneath the support portions and so can be fixed under the support portions by setscrews so as to be combined together with them.

In the children's balance seat according to the present invention, on the strengthening beams of the frame is provided an adjustable spring which is helpful to make the said seat more freely moveable. This spring can be adjusted to suit different body weights.

A specific embodiment of the invention will now be described by way of example with reference to the accompanying drawings.

Figure 1:
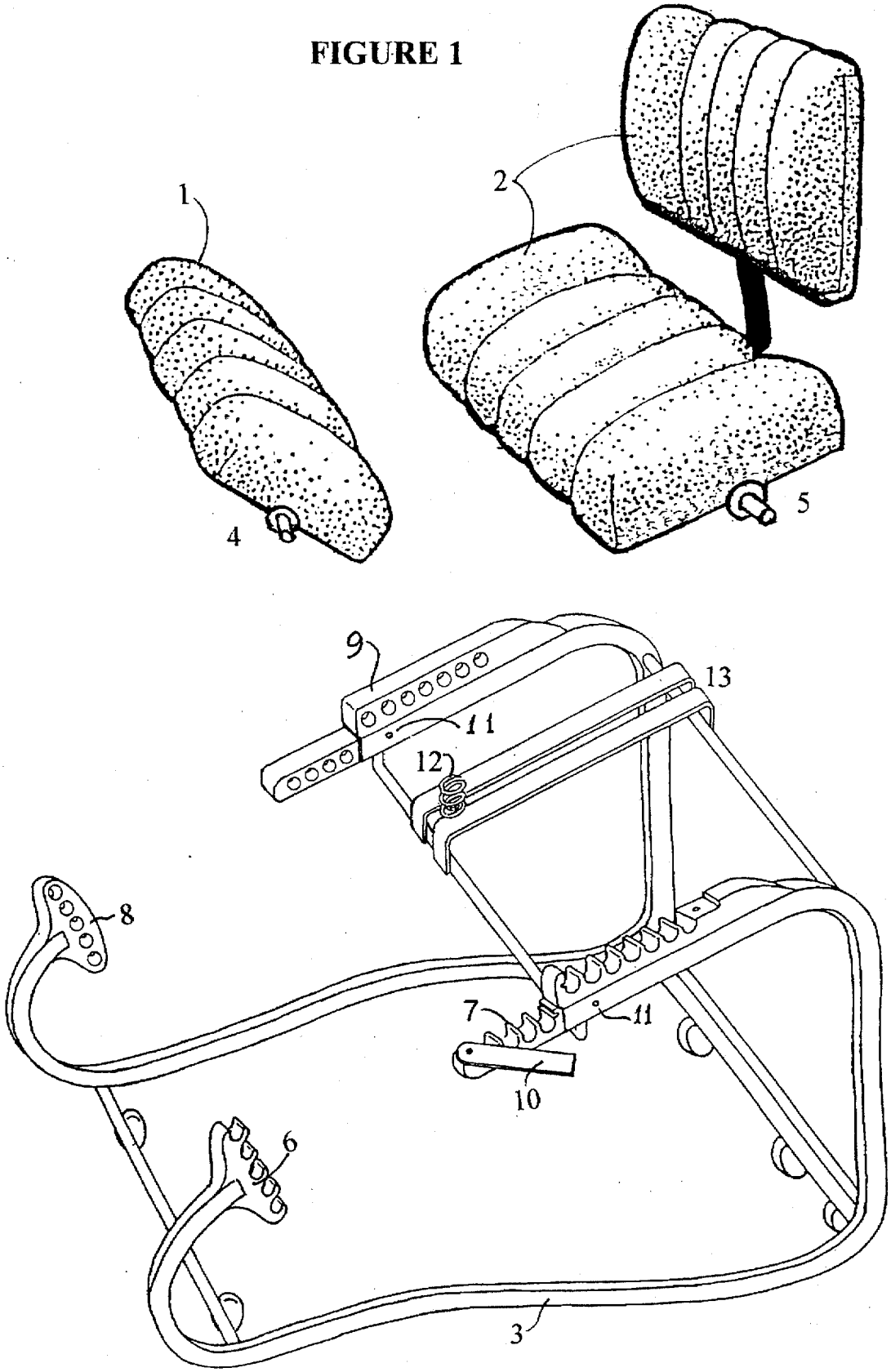
FIG. 1 shows in perspective the balance seat frame with the seat and shin cushion separated from the frame.

Referring to the drawing the child's balance seat comprises detachable shin cushion 1, seat 2 and frame 3. Axles 4 and 5 are secured to the bases of the shin cushion and seat.

The frame 3 is formed in the shape of a sled. At one end of the frame, a support member 7 with a plurality of half-round grooves is provided on one side and a support member 9 with a plurality of round holes is provided opposedly on the other side both for supporting the seat 2. Similarly, at the other end of the frame, a support member 6 with a plurality of half-round grooves in provided on one side and a support member 8 with a plurality of round holes is provided opposedly on the other side both for supporting the shin cushion 1.

In assembly, the shin cushion 1 is mounted on the frame 3 by inserting one end of the shaft 4 into one of holes on support member 8 and putting the other end of it into one of the grooves on support member 6, opposite to the hole. And in the same way, the seat 2 is mounted on the frame 3 by inserting one end of the shaft 5 into one of the holes in support member 9 and putting the other end of it into one of the grooves on support member 7, opposite to the hole.

Figure 2:
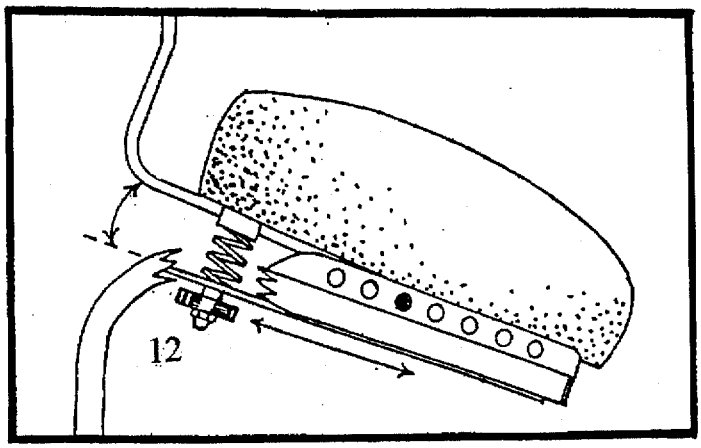
FIG. 2 shows the particular construction of the support members on the frame 3 for supporting the seat 2 with a partial enlargement.

Referring to FIG. 2, the support members 7 and 9 are combination support members including support portions 31, 32 which are integral with the frame 3, and support bars, 33, 34. The support portions 31, 32 are made of solid steel plate drilled and plasma cut to fit the shaft 5. These portions are fixed to the frame which is made of hollow square section tube.

The support bars, each have a corresponding squared section and so can be telescoped into the hollow squared section of the frame 3, and retained under support portions 31, 32 by setscrews 11. As children grow up, the seat 2 can be removed from the support bars 33, 34 and raised onto the support portions 31, 32. In this case, the support bars 33, 34 can be taken away from the frame 3, after setscrews 11 are removed.

When it is desired to change the seat 2 and shin cushion 1 from one position to another position, it can be done by removing one end of shafts 4, 5 each from the holes in which they are, and inserting them into the holes which are desired in the support members 8, 9 and by removing the other end of shaft 4, 5 each from the grooves and inserting them in the desired grooves in the support members 6, 7. A lockplate 10 which is attached, holds the shaft end 5, securely in the groove to ensure safe movement during use.

Further, the stepped arrangement between support portions 31, 32 and support bars 33, 34 makes it possible to mount the seat 2 on them at a desired inclined angle. This feature is useful to meet children's need during their gradual growth.

Figure 3:
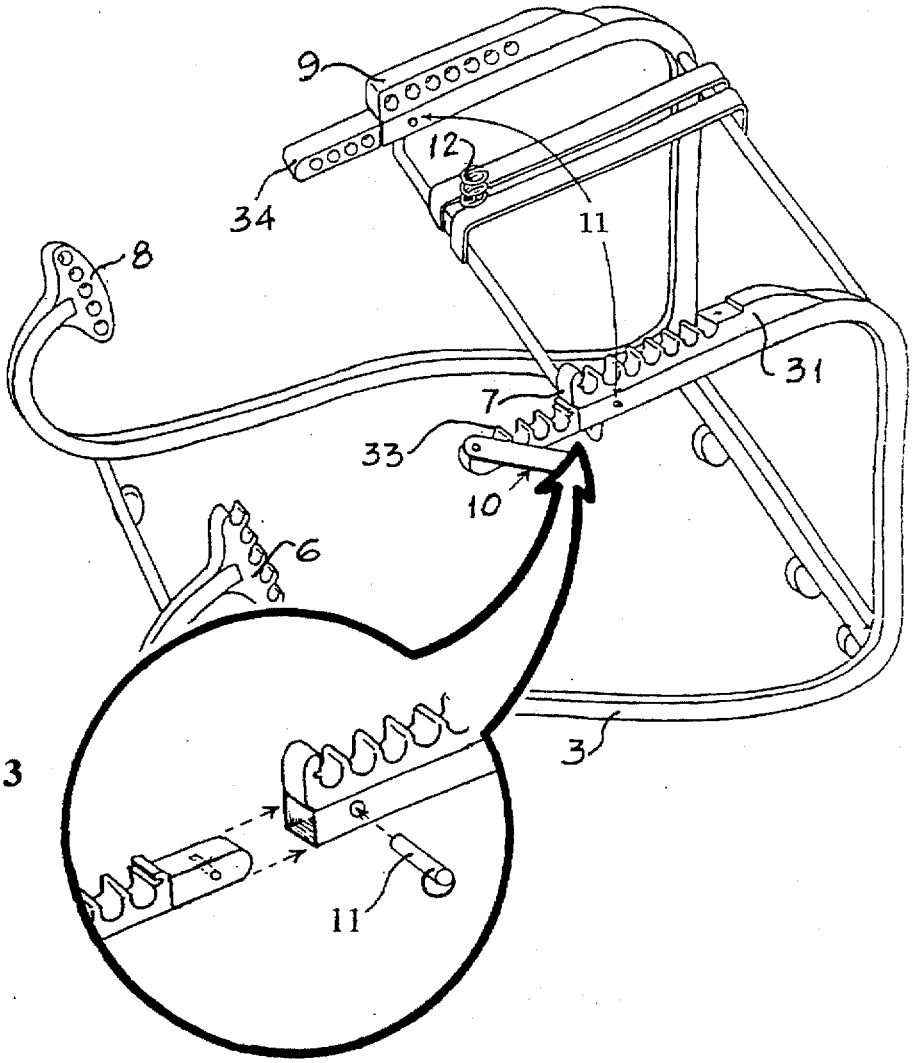
FIG. 3 shows the effect of the balance spring.

Two strengthening beams 13 are provided on the frame 3. A balance spring 12 is straddled and fixed on the beams. Referring to FIG. 3 again, the pre-compression of the spring can be adjusted by the nut under the beams 13. The balance spring is helpful to generate gentle rocking or back and forth movement for the body of the child.

What I claim as my invention is:

1. A child's balance seat comprising a seat, shin cushion and a frame, the frame including two opposite sides, two opposite ends and an upper portion, the seat and shin cushion attached to the upper portion of the frame in a sleigh configuration, the frame including two pairs of support members provided on both sides at both ends of the frame, one pair of the support members on one side including a plurality of round holes, and the other pair of support members, and the other pair of support members on the other side including grooves that correspond to the holes on the other pair of support members, said support members with said holes and said grooves being used to adjustably support said seat and said shin cushion, thereby making said child's balance seat useful:

(a) during periods of gradual growth of a child and (b) in assisting free forward and backward movement of a child's body;

wherein said support members for supporting said seat is a combination support member, the combination support members including support portions integral with the frame at the support members, said frame being tubular and having a hollowed, square cross section, the support members further including support bars having a square cross section slightly smaller than and corresponding to the hollowed, square cross section of the frame for inserting into said hollowed, square cross section of the frame at the support portions allowing the support bars to be telescoped under said support portions and to be fixedly secured beneath the support portions to form the combination support member.

2. A children's balance seat as claimed in claim 1 wherein an adjustable spring can supplement and assist the forward and backward movement referred to in claim 1.

* * * * *